US006825596B1

(12) United States Patent
Cathey

(10) Patent No.: US 6,825,596 B1
(45) **Date of Patent: *Nov. 30, 2004**

(54) ELECTRON EMITTERS WITH DOPANT GRADIENT

(75) Inventor: David A. Cathey, Boise, ID (US)

(73) Assignee: Micron Technology, Inc., Boise, ID (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/609,354

(22) Filed: Mar. 1, 1996

Related U.S. Application Data

(62) Division of application No. 08/089,166, filed on Jul. 7, 1993, now Pat. No. 5,532,177.

(51) Int. Cl.[7] ..... H01J 1/16

(52) U.S. Cl. ..... 313/336; 313/336; 313/309; 313/495; 313/308; 313/351

(58) Field of Search ..... 313/336, 495, 313/308, 309, 351; 437/225; 156/628

(56) References Cited

U.S. PATENT DOCUMENTS

| | | | | |
|---|---|---|---|---|
| 3,665,241 A | | 5/1972 | Spindt et al. | 313/351 |
| 3,755,704 A | | 8/1973 | Spindt et al. | 313/309 |
| 3,812,559 A | * | 5/1974 | Spindt et al. | 313/309 |
| 3,816,194 A | | 6/1974 | Kroger et al. | 156/3 |
| 3,875,442 A | | 4/1975 | Wasa et al. | 313/193 |
| 3,894,332 A | | 7/1975 | Nathanson et al. | 29/578 |
| 3,970,887 A | * | 7/1976 | Smith et al. | 313/309 |
| 4,301,429 A | | 11/1981 | Goldman et al. | 333/22 R |
| 4,400,866 A | * | 8/1983 | Yeh et al. | 29/571 |
| 4,420,872 A | | 12/1983 | Solo de Zaldivar | 29/571 |
| 4,718,973 A | | 1/1988 | Abraham et al. | 156/628 |
| 4,766,340 A | * | 8/1988 | van der Mast et al. | 313/309 |
| 4,874,981 A | | 10/1989 | Spindt | 313/309 |
| 4,943,343 A | | 7/1990 | Bardai et al. | |
| 4,964,946 A | | 10/1990 | Gray et al. | 156/643 |
| 4,968,382 A | | 11/1990 | Jacobson et al. | 156/643 |
| 5,063,327 A | * | 11/1991 | Brodie et al. | 313/309 |
| 5,090,932 A | | 2/1992 | Dieumegard et al. | 445/24 |
| 5,138,220 A | | 8/1992 | Kirkpatrick | 313/309 |
| 5,201,992 A | | 4/1993 | Marcus et al. | 156/643 |
| 5,269,877 A | | 12/1993 | Bol | 156/628 |
| 5,315,126 A | * | 5/1994 | Field | 313/346 R |
| 5,330,920 A | | 7/1994 | Soleimani et al. | 437/24 |
| 5,358,908 A | * | 10/1994 | Reinberg et al. | 437/228 |
| 5,378,658 A | | 1/1995 | Toyoda et al. | 437/228 |
| 5,431,777 A | | 7/1995 | Austin et al. | 156/622.1 |

(List continued on next page.)

FOREIGN PATENT DOCUMENTS

| | | | |
|---|---|---|---|
| JP | 57-43412 | 3/1982 | H01L/21/205 |
| JP | 3-238729 | 10/1991 | H01J/9/02 |

OTHER PUBLICATIONS

G. W. Jones et al., "Fabrication of Silicon Point, Wedge, and Trench FEAs" Technical Digest of IVMC 91, 1991 pp 34,35.*

(List continued on next page.)

*Primary Examiner*—Nimeshkumar D. Patel
*Assistant Examiner*—Holly Harper
(74) *Attorney, Agent, or Firm*—TraskBritt

(57) ABSTRACT

Electron emitters and a method of fabricating emitters which have a concentration gradient of impurities, such that the highest concentration of impurities is at the apex of the emitters, and decreases toward the base of the emitters. The method comprises the steps of doping, patterning, etching, and oxidizing the substrate, thereby forming the emitters having impurity gradients.

30 Claims, 3 Drawing Sheets

U.S. PATENT DOCUMENTS

| | | | | | |
|---|---|---|---|---|---|
| 5,469,014 | A | * | 11/1995 | Itoh et al. | 313/309 |
| 5,532,177 | A | | 7/1996 | Cathey | 437/40 |
| 5,552,613 | A | * | 9/1996 | Nishibayashi et al. | 257/10 |
| 5,583,393 | A | | 12/1996 | Jones | 313/495 |
| 5,662,815 | A | * | 9/1997 | Kim | 216/11 |
| 5,703,380 | A | * | 12/1997 | Potter | 257/10 |
| 5,786,659 | A | | 7/1998 | Takagi et al. | 313/309 |
| 6,031,250 | A | * | 2/2000 | Brandes et al. | 257/77 |
| 6,049,089 | A | * | 4/2000 | Cathey | 257/10 |
| 6,091,188 | A | | 7/2000 | Tomihari et al. | |

OTHER PUBLICATIONS

*Integrated Electronics : Analog and Digital Circuits and Systems* by J. Millman et al. pp 204–205, 1972 (no month).*

Jones et al., Fabrication of Silicon Point, Wedge, and Trench FEAs, Technical Digest of IVMC 91, Nagahama, pp 34, 35, 1991.*

Hunt, Charles E., Johann T. Trujillo, William J. Orvis, "Structure and Electrical Characteristics of Silicon Field–Emission Microelectronic Devices," IEEE Transactions on Electron Devices, vol. 38, No. 10, Oct. 1991.

Marcus, R. B., T. S. Ravi, T. Gmitter, H. H. Busta, J. T. Niccum, K. K. Chin, and D. Liu, "Atomically Sharp Silicon and Metal Field Emitters," IEEE Transactions on Electron Devices, vol. 38, No. 10, Oct. 1991.

Wolf, Stanley, Silicon Processing for the VLSI ERA, vol. 2: Process Integration, Lattice Press, Sunset Beach, California, pp. 20–27, 1990, (no month).

* cited by examiner

ELECTRON EMITTERS WITH DOPANT GRADIENT

RELATED APPLICATIONS

This application is a divisional application of Ser. No. 08/089,166, filed Jul. 7, 1993, which is now U.S. Pat. No. 5,532,177, issued Jul. 7, 1993.

FIELD OF THE INVENTION

This invention relates to field emitter technology, and more particularly, to electron emitters and method for forming them.

BACKGROUND OF THE INVENTION

Cathode ray tube (CRT) displays, such as those commonly used in desk-top computer screens, function as a result of a scanning electron beam from an electron gun, impinging on phosphors on a relatively distant screen. The electrons increase the energy level of the phosphors. The phosphors release energy imparted to them from the bombarding electrons, thereby emitting photons, which photons are transmitted through the glass screen of the display to the viewer.

Flat panel displays have become increasingly important in appliances requiring lightweight portable screens. Currently, such screens use electroluminescent, liquid crystal, or plasma technology. A promising technology is the use of a matrix addressable array of cold cathode emission devices to excite phosphor on a screen.

In U.S. Pat. No. 3,875,442, entitled "Display Panel," Wasa et. al. disclose a display panel comprising a transparent gas-tight envelope, two main planar electrodes which are arranged within the gas-tight envelope parallel with each other, and a cathodeluminescent panel. One of the two main electrodes is a cold cathode, and the other is a low potential anode, gate, or grid. The cathode luminescent panel may consist of a transparent glass plate, a transparent electrode formed on the transparent glass plate, and a phosphor layer coated on the transparent electrode. The phosphor layer is made of, for example, zinc oxide which can be excited with low energy electrons.

Spindt, et. al. discuss field emission cathode structures in U.S. Pat. Nos. 3,665,241, and 3,755,704, and 3,812,559, and 4,874,981. To produce the desired field emission, a potential source is provided with its positive terminal connected to the gate, or grid, and its negative terminal connected to the emitter electrode (cathode conductor substrate). The potential source may be made variable for the purpose of controlling the electron emission current. Upon application of a potential between the electrodes, an electric field is established between the emitter tips and the grid, thus causing electrons to be emitted from the cathode tips through the holes in the grid electrode.

An array of points in registry with holes in grids are adaptable to the production of gate emission sources subdivided into areas containing one or more tips from which areas of emission can be drawn separately by the application of the appropriate potentials thereto.

There are several methods by which to form the electron emission tips. Examples of such methods are presented in U.S. Pat. No. 3,970,887 entitled, "Micro-structure Field Emission Electron Source."

SUMMARY OF THE INVENTION

The performance of a field emission display is a function of a number of factors, including emitter tip or edge sharpness.

In the process of the present invention, a dopant material which effects the oxidation rate or the etch rate of silicon, is diffused into a silicon substrate or film. "Stalks" or "pillars" are then etched, and the dopant differential is used to produce a sharpened tip. Alternatively, "fins" or "hedges" may be etched, and the dopant differential used to produce a sharpened edge.

One of the advantages of the present invention is the manufacturing control, and available process window for fabricating emitters, particularly if a high aspect ratio is desired. Another advantage of the present invention is its scalability to large areas.

BRIEF DESCRIPTION OF THE DRAWINGS

The present invention will be better understood from reading the following description of nonlimitative embodiments, with reference to the attached drawings, below.

DETAILED DESCRIPTION OF THE INVENTION

Figure 1:
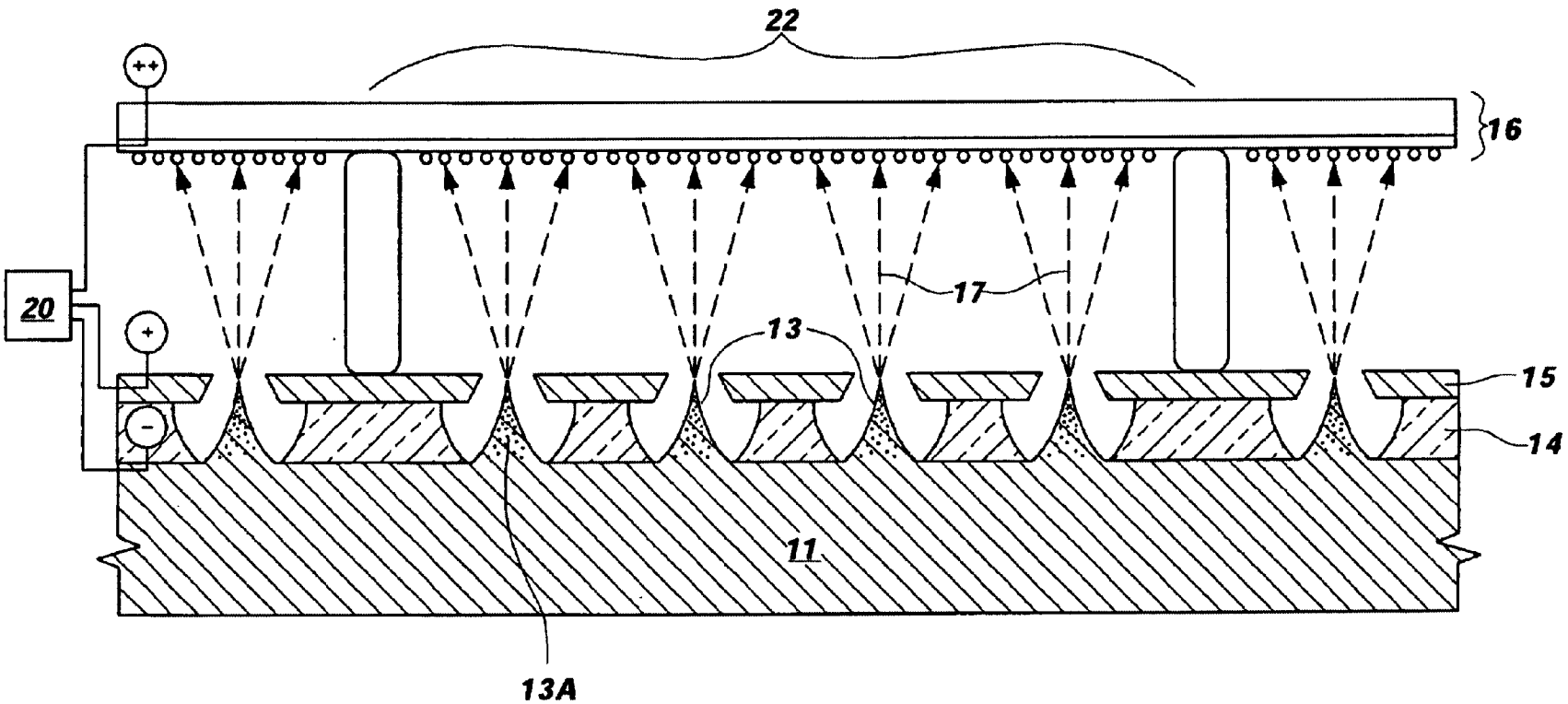
FIG. 1 is a schematic cross-section of a field emission device in which the emitter tips or edges formed from the process of the present invention can be used.

Referring to FIG. 1, a field emission display employing a pixel 22 is depicted. In this embodiment the cold cathode emitter tip 13 of the present invention is depicted as part of the pixel 22. In an alternative embodiment, the emitter 13 is in the shape of an elongated wedge, the apex of such a wedge being referred to as a "knife edge" or "blade."

The schematic cross-sections for the alternative embodiment are substantially similar to those of the preferred embodiment in which the emitters 13 are tips. From a top view (not shown) the elongated portion of the wedge would be more apparent.

FIG. 1 is merely illustrative of the many applications for which the emitter 13 of the present invention can be used. The present invention is described herein with respect to field emitter displays, but one having ordinary skill in the art will realize that it is equally applicable to any other device or structure employing a micro-machined point, edge, or blade, such as, but not limited, to a stylus, probe tip, fastener, or fine needle.

The substrate 11 can be comprised of glass, for example, or any of a variety of other suitable materials, onto which a conductive or semiconductive material layer, such as doped poly crystalline silicon can be deposited. In the preferred embodiment, single crystal silicon serves as a substrate 11, from which the emitters 13 are directly formed. Other substrates may also be used including, but not limited to macrograin polysilicon and monocrystalline silicon; the selection of which may depend on cost and availability.

If an insulative film or substrate is used with the process of the present invention, in lieu of the conductive or semiconductive film or substrate 11, the micro-machined emitter 13 should be coated with a conductive or semiconductive material, prior to doping.

At a field emission site, a micro-cathode 13 (also referred to herein as an emitter) has been constructed in the substrate 11. The micro-cathode 13 is a protuberance which may have a variety of shapes, such as pyramidal, conical, wedge, or other geometry which has a fine micro-point, edge, or blade for the emission of electrons. The micro-tip 13 has an apex and a base. The aspect ratio (i.e., height to base width ratio) of the emitters 13 is preferably greater than 1:1. Hence, the preferred emitters 13 have a tall, narrow appearance.

The emitter 13 of the present invention has an impurity concentration gradient, indicated by the shaded area 13*a*) in which the concentration is higher at the apex and decreases towards the base.

Surrounding the micro-cathode 13, is an extraction grid or gate structure 15. When a voltage differential, through source 20, is applied between the cathode 13 and the gate 15, an electron stream 17 is emitted toward a phosphor coated screen 16. The screen 16 functions as the anode. The electron stream 17 tends to be divergent, becoming wider at greater distances from the tip of cathode 13.

The electron emitter 13 is integral with the semiconductor substrate 11, and serves as a cathode conductor. Gate 15 serves as a grid structure for its respective cathode 13. A dielectric insulating layer 14 is deposited on the substrate 11. However, a conductive cathode layer (not shown) may also be disposed between the insulating layer 14 and the substrate 11, depending upon the material selected for the substrate 11. The insulator 14 also has an opening at the field emission site location.

The process of the present invention, by which the emitter 13 having the impurity concentration gradient is fabricated, is described below. Accordingly, the figures relevant to this description could be characterized as illustrating an "in-process " device, which is a device that is in the process of being made.

Figure 2:
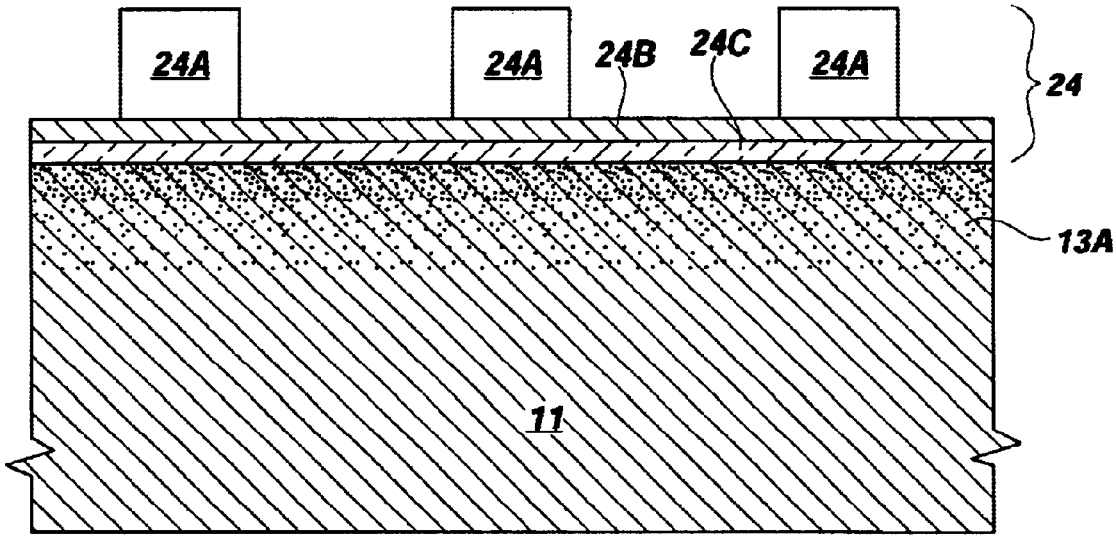
FIG. 2 is a schematic cross-section of the doped substrate of the present invention superjacent to which is a mask, in this embodiment the mask comprises several layers.

FIG. 2 shows the substrate or film 11 which is used to fabricate a field emitter 13. The substrate 11 is preferably single crystal silicon. An impurity material 13*a* is introduced into the film 11 in such a manner so as to create a concentration gradient from the top of the substrate surface 11 which decreases with depth down into the film or substrate 11. Preferably, the impurity 13*a* is from the group including, but not limited to boron, phosphorus, and arsenic.

The substrate 11 can be doped using a variety of available methods. The impurities 13*a* can be obtained from a solid source diffusion disc or gas or vapor feed source, such as POCl, or from spin on dopant with subsequent heat treatment or implantation or CVD film deposition with increasing dopant component in the feed stream, through time of deposition, either intermittently or continuously.

In the case of a CVD or epitaxially grown film, it is possible to introduce an impurity which decreases throughout the deposition and serves as a component for retarding the consumptive process subsequently employed in the process of the present invention. An example is the combination of a silicon film or substrate 11, doped with a boron impurity 13*a*, and etched with a ethylene diamine pyrocatechol (EDP) etchant, where the EDP is employed after anisotropically etching pillars or fins from material 11.

In the preferred embodiment, the substrate 11 is silicon. After doping, the film or substrate 11 is then patterned, preferably with a resist/silicon nitride/silicon oxide sandwich etch mask 24 and dry etched. Other types of materials can be used to form the mask 24, as long as they provide the necessary selectivity to the substrate 11. The silicon nitride/silicon oxide sandwich has been selected due to its tendency to assist in controlling the lateral consumption of silicon during thermal oxidation, which is well known in semiconductor LOCOS processing.

Figure 3:
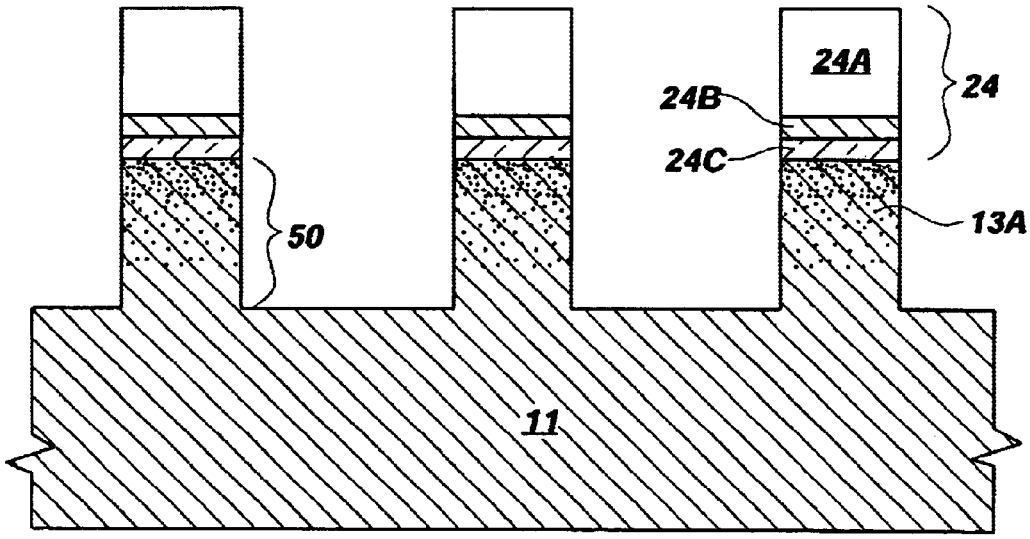
FIG. 3 is a schematic cross-section of the substrate of FIG. 2, after the substrate has been patterned and etched according to the process of the present invention.

The structure of FIG. 2 is then etched, preferably using a reactive ion, crystallographic etch, or other etch method well known in the art. Preferably the etch is substantially anisotropic, i.e., having undercutting which is reduced and controlled, thereby forming "pillars" 50 extending from a surface etched from the substrate 11. T hese "pillars" 50 are depicted in FIG. 3 and will be the sites of the emitter tips 13 of the present invention.

Figure 4:
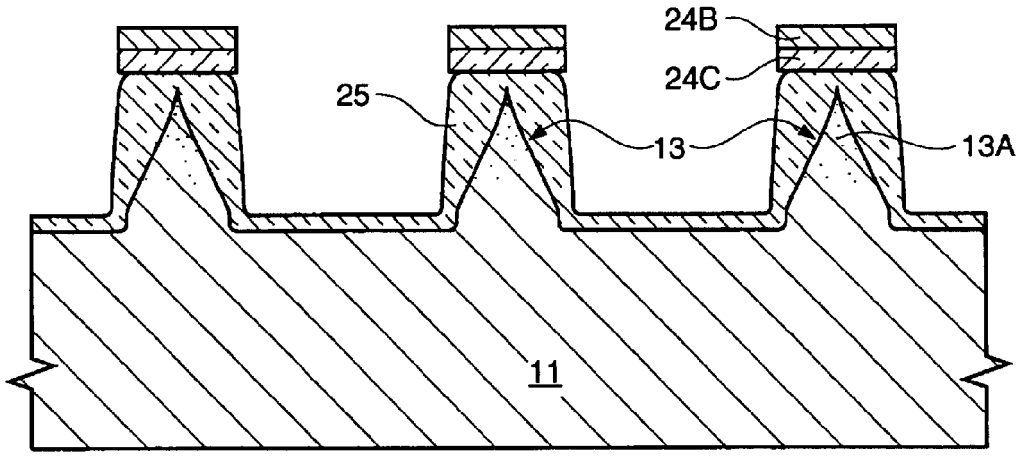
FIG. 4 is a schematic cross-section of the substrate of FIG. 3, after the tips or edges have been formed, according to the process of the present invention.

FIG. 4 illustrates the substrate 11 having emitter tips 13 formed therein. The resist portion 24*a* of the mask 24 has been removed. An oxidation is then performed, wherein an oxide layer 25 is disposed about the tip 13, and subsequently removed.

Alternatively, an etch, is performed, the rate of which is dependent upon (i.e., function of) the concentration of the contaminants (impurities exposed to a consumptive process, whereby the rate or degree of consumption is a function of the impurity concentration, such as the thermal oxidation of silicon which has been doped with phosphorus 13*a*).

The etch, or oxidation, proceeds at a faster rate in areas having higher concentration of impurities. Hence, the emitters 13 are etched faster at the apex, where there is an increased concentration of impurities 13*a*, and slower at the base, where there is a decrease in the concentration 13*a*.

The etch is preferably non-directional in nature, removing material of a selected purity level in both horizontal and vertical directions, thereby creating an undercut. The amount of undercut is related to the impurity concentration 13*a*.

Figure 5:
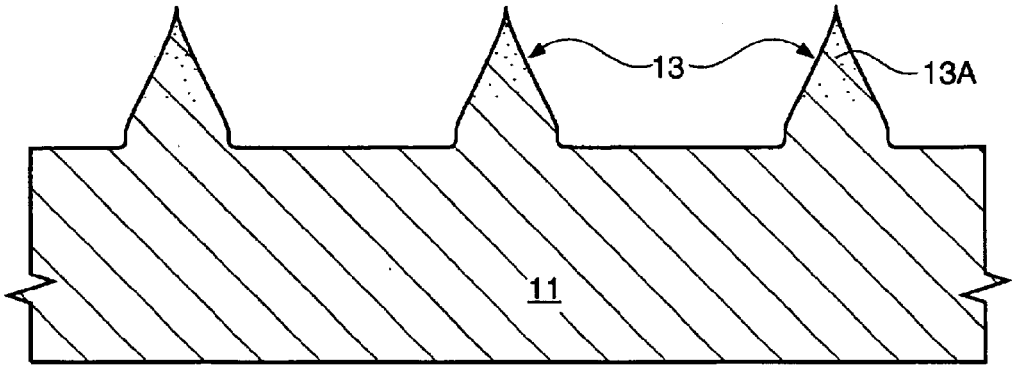
FIG. 5 is a schematic cross-section of the tips or edges of FIG. 4, after the nitride and oxide layers of the mask have been removed.

FIG. 5 shows the emitters 13 following the removal of the nitride 24*b* and oxide 24*c* layers, preferably by a selective wet stripping process. An example of such a stripping process involves 1:100 solution of hydrofluoric acid (HF)/water at 20° C., followed by a water rinse. Next is a boiling phosphoric acid ($H_3PO_4$)/water solution at 140° C., followed by a water rinse, and 1:4 hydrofluoric acid (HF)/water solution at 20° C. The emitters 13 of the present invention are thereby exposed. It should be noted that, in the embodiment depicted in FIG. 5, the impurity concentration 13*a* at the base of the emitters 13 is generally zero.

All of the U.S. Patents cited herein are hereby incorporated by reference herein as if set forth in their entirety.

While the particular process as herein shown and disclosed in detail is fully capable of obtaining the objects and advantages herein before stated, it is to be understood that it is merely illustrative of the presently preferred embodiments of the invention and that no limitations are intended to the details of construction or design herein shown other than as described in the appended claims. For example, one having ordinary skill in the art will realize that the emitters can be used in a number of different devices, including but not limited to field emission devices, cold cathode electron emission devices, micro-tip cold cathode vacuum triodes.

What is claimed is:

1. An emitter comprising:

a single-layered substrate formed of a first material;

a tapered protuberance integrally formed from the first material of said single-layered substrate, said protuberance having an apex and a base;

a first dopant dispersed through said protuberance in a dopant concentration having a gradient, said dopant concentration greater at said apex, decreasing toward said base, and zero at said base; and a second dopant dispersed through said protuberance in a dopant concentration having a gradient, said dopant concentration greater at said apex, decreasing toward said base, and zero at said base, said second dopant being different than said first dopant.

2. The emitter of claim 1, wherein:

said apex further comprises a sharpened tip or a sharpened edge.

3. The emitter of claim 1, wherein said first dopant and said second dopant each comprises one selected from the group consisting of arsenic, boron, phosphorous, and mixtures thereof.

4. The emitter of claim 1, wherein said emitter is disposed in an array of similar emitters.

5. The emitter of claim 1, wherein said emitter is disposed in a pixel.

6. The emitter of claim 1, wherein said emitter is disposed in a display device.

7. The emitter of claim 1, wherein said emitter is disposed in a field emitter device.

8. The emitter of claim 1, wherein said emitter has an aspect ratio greater than 1:1.

9. An emitter formed from a substrate comprising:

a single layer of a substrate composition including a first substrate-projecting composition, a second composition disposed within the first substrate-projecting composition, and a third composition disponsed within said first substrate projecting composition, a geometric configuration having a base and an apex formed from said first substrate-projecting composition, said first substrate-projecting composition having a first oxidation rate, a second composition disposed within said first substrate-projecting composition forming said geometric configuration in a second composition concentration having a concentration generally zero at said base and having a gradient increasing in concentration from said base to a maximum concentration at said apex, said second composition having a second oxidation rate substantially greater than said first oxidation rate, and a third composition disposed within said first substrate-projecting composition forming said geometric configuration in a second composition concentration having a concentration generally zero at said base and having a gradient increasing in concentration from said base to a maximum concentration at said apex, said third composition having a third oxidation rate different than said first oxidation rate and said second oxidation rate.

10. The emitter of claim 9 wherein said geometric configuration tapers to a point at said apex.

11. The emitter of claim 9 wherein said geometric configuration tapers to an edge at said apex.

12. The emitter of claim 9 wherein said first composition further comprises a conductor or a semiconductor.

13. The emitter of claim 9 wherein said second composition is selected from a group consisting of arsenic, boron, phosphorous, and mixtures thereof.

14. An emitter formed from a substrate comprising:

a substrate having a single layer of a composition, said substrate comprising at least one integral geometric configuration formed from said composition of said substrate, said at least one geometric configuration having a base and an apex formed from said composition including a first constituent of said composition, a second constituent, and a third constituent of said composition, said third constituent having a concentration gradient in said at least one geometric configuration of said composition increasing from generally zero at said base to said apex, said composition having a consumption rate defined as a function of a second constituent concentration gradient and said third constituent concentration gradient.

15. The emitter of claim 14 wherein said geometric configuration tapers to a point at said apex.

16. The emitter of claim 14 wherein said geometric configuration tapers to an edge at said apex.

17. The emitter of claim 14 wherein said first constituent further comprises a conductor or a semiconductor.

18. The emitter of claim 14 wherein said second constituent is selected from a group consisting of arsenic, boron, phosphorous, and mixtures thereof.

19. The emitter of claim 14 wherein said consumption rate increases with said second constituent concentration gradient.

20. The emitter of claim 14 wherein said consumption rate is for an oxidative consumption reaction.

21. The emitter of claim 14 wherein said consumption rate is for an etching consumption reaction.

22. An emitter array comprising:

a single-layered substrate including a first composition, said first composition comprising a conductive or a semiconductive material;

a plurality of geometric configurations having a base and an apex formed in and of a portion of said substrate from said first composition, said first composition having a first oxidation rate;

a second composition disposed within each of said geometric configurations in a second composition concentration gradient increasing from generally zero at said base to said apex, said second composition having a second oxidation rate substantially greater than said first oxidation rate; and a third composition disposed within each of said geometric configurations in a second composition concentration gradient increasing from generally zero at said base to said apex, said third composition having a third oxidation rate different than said first oxidation rate and said second oxidation rate.

23. The emitter of claim 22 wherein said second composition is selected from a group consisting of arsenic, boron, phosphorous, and mixtures thereof.

24. An emitter array comprising:

a single-layered substrate including a first constituent, said first constituent comprising a conductive or a semiconductive material; and a plurality of geometric configurations, each geometric configuration having a base and an apex formed from a portion of said substrate from said first constituent, each geometric configuration of geometric configurations having a second constituent concentration gradient increasing from generally zero at said base to a maximum concentration at said apex, each of said geometric configurations having a consumption rate defined as a function of said second constituent concentration gradient and having a third constituent concentration gradient increasing from generally zero at said base to a maximum concentration at said apex, each of said geometric configurations having a consumption rate defined as a function of said third constituent concentration gradient.

25. The emitter of claim 24, wherein said first constituent is selected from a group consisting of arsenic, boron, phosphorous, and mixtures thereof.

26. The emitter array of claim 24, wherein said consumption rate increases with said second constituent gradient.

27. The emitter of claim 24, wherein said consumption rate is for an oxidative consumption reaction.

28. The emitter of claim 24, wherein said consumption rate is for an etching consumption reaction.

29. An emitter comprising:

a cold cathode formed from a single layered substrate having at least one dopant located in the upper portion thereof;

an apex having a first dopant concentration;

a generally dopant-free base integral to said substrate; and a middle area between said apex and said base having a second dopant concentration less than said first dopant concentration, said second dopant concentration having a decreasing gradient ranging from said apex to said base, said first dopant concentration having a decreasing gradient generally equal to said gradient of said second dopant concentration.

30. A field emission site, comprising:

a generally pure single layered substrate formed of a first material, a second material, and a third material; and a cathode formed from said single layered substrate, said cathode having an apex and a base and defining an increasing range of widths from said apex to said base, said cathode having a purity of a mixture of said first material, said second material, and said third material of said single layered substrate generally directly proportional to said range of widths, said base generally pure formed of said first material and said third material, said apex having said second material located therein and substantially no third material located therein.

* * * * *